US006199408B1

(12) United States Patent
Shibata

(10) Patent No.: US 6,199,408 B1
(45) Date of Patent: Mar. 13, 2001

(54) COOLING APPARATUS FOR KNITTING COMPONENTS

(75) Inventor: Takao Shibata, Takatsuki (JP)

(73) Assignee: Precision Fukuhara Works, Ltd. (JP)

( * ) Notice: Subject to any disclaimer, the term of this patent is extended or adjusted under 35 U.S.C. 154(b) by 0 days.

(21) Appl. No.: 09/485,770

(22) PCT Filed: Jun. 14, 1999

(86) PCT No.: PCT/JP99/03173

§ 371 Date: Feb. 24, 2000

§ 102(e) Date: Feb. 24, 2000

(87) PCT Pub. No.: WO99/66114

PCT Pub. Date: Dec. 23, 1999

(30) Foreign Application Priority Data

Jun. 16, 1998 (JP) ..... 10-167902

(51) Int. Cl.[7] ..... D04B 35/30
(52) U.S. Cl. ..... 66/8; 66/168
(58) Field of Search ..... 66/8, 7, 79, 114, 66/115, 168, 1 R

(56) References Cited

U.S. PATENT DOCUMENTS 3,535,895 * 10/1970 Krauss .
5,129,240 * 7/1992 Schindler .
5,408,850 * 4/1995 Kawase et al. .
5,689,977 * 11/1997 Yorisue et al. .
5,737,942 * 4/1998 Gutschmit .

* cited by examiner

*Primary Examiner*—Danny Worrell
(74) *Attorney, Agent, or Firm*—Alston & Bird LLP

(57) ABSTRACT

A needle-selecting actuator (5) is surrounded by an intermediate ring (7) at the top, a lower ring (9) at the bottom, a needle cylinder (2) inside, and a cover (12) outside. A cylindrical chamber (13) is formed between the needle-selecting actuator (5) and the cover (12). The cover (12) is equipped with a ventilator fan (17) for feeding the air into the cylindrical chamber (13). The cylindrical chamber (13) has an opening (14, 15; 18) through which the air passes. The outside air is fed into the cylindrical chamber (13) through the means of ventilation/suction (17), and passes through said opening (14, 15; 18) to cool the needle cylinder (2) and its peripheral working components.

10 Claims, 2 Drawing Sheets

COOLING APPARATUS FOR KNITTING COMPONENTS

FIELD OF THE INVENTION

This invention relates to a cooling apparatus for knitting components (needle cylinder, cam holder, needle-selecting actuator and other peripheral parts) in a circular knitting machine.

BACKGROUND OF THE INVENTION

When a circular knitting machine is in operation, frictional heat is generated between its components. The frictional heat causes thermal expansion and deformation of the components. Such expansion and deformation cause damage to knitting tools such as knitting needles and jacks, and brings about abnormalities of the needle selecting apparatus, producing pattern errors. This is a long-standing problem, which has become more serious in recent years. The speed of operation is increasing, and knitting machines are getting larger and larger, resulting in greater thermal friction. The increase in the use of electronic parts has also added to the amount of heat generation.

As a way of solving this problem, a number of methods for cooling the cylinder by air or water were proposed in the past.

For example, JP-A-4-245963 (1992) discloses a cylinder that is provided with a fluid path through which the air or fluid medium can flow to cool the cylinder. Forming a fluid path directly on the cylinder, however, entails a high manufacturing cost. It is also suspected that the direct cooling effect extends only to the cylinder, leaving the peripherals insufficiently cooled.

According to JP-A-6-287844 (1994) by the present applicant, an orifice is provided between the cylinder and the fabric in the lower part of the knitting section of the knitting machine to cool the cylinder and its peripherals as well as to remove and discharge fiber dust, etc. According to this prior invention, not only the cylinder but also the peripherals are cooled.

According to JP-A-10-60759 (1998), an annular air chamber is established between the cylinder and the dial, and a pressurized airflow is fed into it. The invention of this Japanese application was originally intended to provide an apparatus for preventing airborne cotton or dust, and the cooling of the knitting components per se is not mentioned at all in the specification. However, as long as an airflow is generated around the cylinder, a cooling effect on the cylinder would be expected. At first glance, this configuration resembles that of the present invention. Therefore, this prior apparatus will be discussed further in the section describing the effects of the prior apparatus by way of comparison with the present invention.

SUMMARY OF THE INVENTION

It is an object of the present invention to produce an apparatus that exhibits an improved cooling effect on the knitting components as an improvement on the apparatus disclosed in the above-mentioned JP-A-10-60759 (1998).

The cooling apparatus for knitting components in a circular knitting machine of the present invention is a cooling apparatus for knitting components in a circular knitting machine equipped with a needle selecting actuator for knitting a jacquard fabric. The needle selecting actuator is surrounded by an upper shield at the top, a lower shield at the bottom, a needle cylinder inside and a cover outside, and a cylindrical chamber is formed between the needle selecting actuator and the cover. The cover is equipped with ventilation means for feeding the air into the cylindrical chamber, and the cylindrical chamber has an opening through which the air passes. In this way, the outside air is fed into the cylindrical chamber by the ventilation means and passes through the opening to cool the needle cylinder and its peripheral knitting components.

The opening of the cylindrical chamber is, for example, a gap in the periphery of the cover. It is preferable to form the upper end of the cover in an inverted L shape orientated towards the other peripheral working components. The size of the gap in the periphery of the cover is, for example, 5–50 mm.

The opening of the cylindrical chamber can also consist of holes that penetrate the upper shield. These holes are preferably slanted so as to be orientated towards the other peripheral working components. The size of each hole is, for example, 5–20 mm, and the number of holes is, for example, 10–100.

DETAILED DESCRIPTION OF THE PREFERRED EMBODIMENTS

Embodiments of the present invention will now be described by reference to the accompanying drawings.

Figure 1:
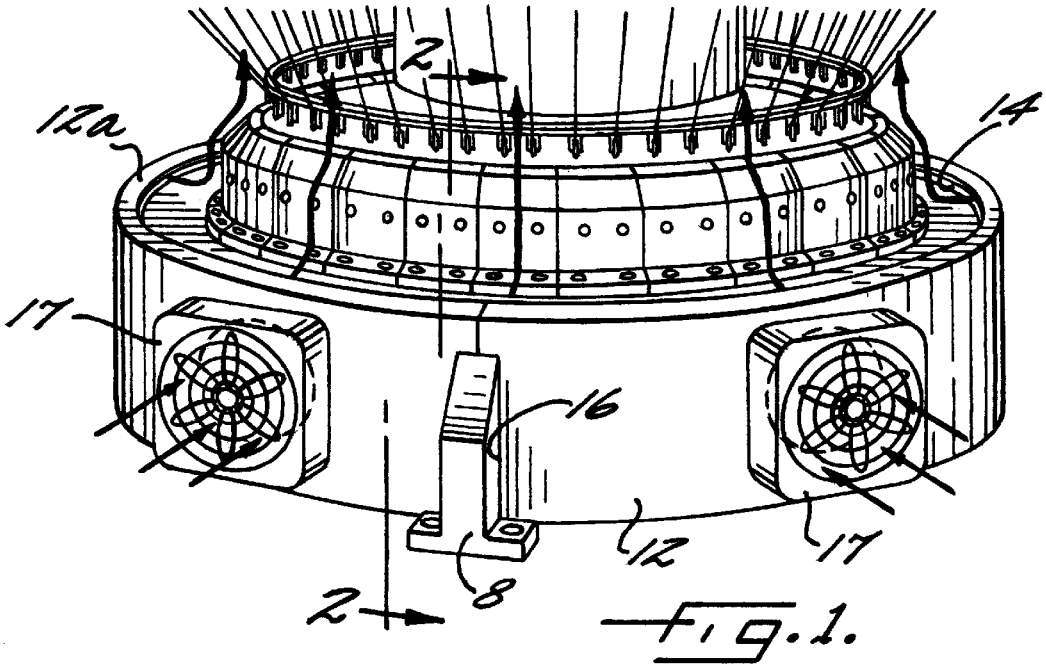
FIG. 1 is a cross sectional view of the knitting section of a circular knitting machine according to a first embodiment of the present invention.

FIG. 1 is a cross sectional view of the knitting section of a circular knitting machine according to the first embodiment of the present invention. The knitting section is established above a bed 1 which is supported by a number of legs (not shown). The main components of the knitting section are the cylinder needle part, the yarn carrier part, the actuator part and the knitting needle controlling cam part.

In the cylinder needle part, a cylinder needle (not shown) is disposed in such a way that it is vertically slidable along a needle groove (not shown) formed on the periphery of a rotary needle cylinder 2. The rotary needle cylinder 2 rotates at the same speed as a gear ring 3 which is positioned beneath the needle cylinder 2. In the yarn carrier part, a yarn carrier 4 feeds yarn to the knitting needle. In the actuator part 5, needles are selected in such a way as to give variety to the knit fabric. In the cylinder needle controlling cam part, a cam (not shown) housed in a cylinder cam holder 6 imparts a vertically reciprocal movement to the cylinder needle.

The cylinder cam holder 6 is supported by an annular intermediate ring 7, and the intermediate ring is further supported by the bed 1 via a support 8. The actuator 5 is established on a lower ring 9 which is fastened to the bed.

The machine shown in FIG. 1 is a double-knit circular knitting machine, which also has a dial needle part and a dial needle controlling cam part. In the dial needle part, a dial needle (not shown) is disposed in such a way that it is horizontally slidable along a needle groove formed on the upper surface of a needle dial 10. In the dial needle controlling cam part, a cam (not shown) housed in a dial cam holder 11 imparts a horizontally reciprocal movement to the dial needle.

On the peripheral side of the space between the intermediate ring 7 and the lower ring 9, a cylindrical cover 12 is mounted. This cover 12 forms a cylindrical chamber 13 which is enclosed by the intermediate ring 7 at the top, the lower ring 9 at the bottom, and the actuator 5 and the cover 12 at the sides.

The lower end of the cover 12 makes contact with the lower ring 9, while the upper end is positioned slightly above the upper surface of the intermediate ring 7. The top portion 12*a* of cover 12 has an inverted L shape in cross-section. Between this inverted L shaped top portion 12a and the upper surface of the intermediate ring, there is established an opening 14 that opens to the cylinder cam holder 6, while a gap 15 is also established between the periphery of the intermediate ring and the cover 12 so that the air flow is not obstructed. The size of the opening 14 and the gap 15 is preferably 5 to 30 mm, more preferably 10–20 mm, and most preferably about 15 mm.

Because the purpose of the cover 12 is to form an air-flow passage, it could be made of any material, but from the standpoints of ease of manufacture, weight and cost, synthetic resin is preferable. Such synthetic resin could be transparent or colored. The synthetic resin, however, must have the strength to endure the passage of the air flow as well as the load of a ventilator fan described below.

Figure 4:
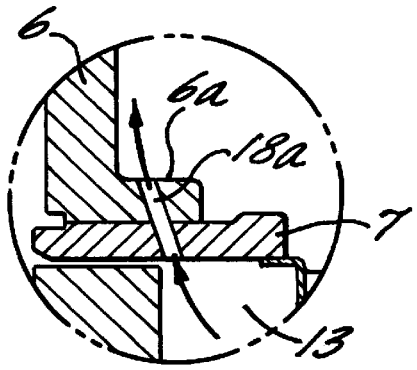
FIG. 4 is a perspective view of the knitting section of the circular knitting machine according to the first embodiment of the present invention shown in FIG. 1.

As shown in FIG. 4, the cover is usually a unit consisting of from two to six elements, and each element is provided with an opening 16 for housing a support and another opening (blocked by a fan and not visible in FIG. 4) for housing the ventilator fan described below. The two to six cover elements could be completely joined with each other with their end surfaces in contact with each other, but for the ease of repair or replacement of the actuator or cleaning of the cylindrical chamber, the end surfaces of the cover elements are preferably positioned slightly disaligned from each other inward or outward, and a rail is provided at the lower end of the cover so that the cover elements can slide.

In order to feed the outside air into the cylindrical chamber 13 through the opening on the side wall of the cover, at least one ventilator fan 17 is attached thereto.

For the ventilator fan 17, a propeller fan, for example, by Oriental Motor K.K., Taiko-ku, Tokyo, (model number: MU1238A-11B) can be used. The number of fans can vary according to the size of the circular knitting machine, but for a circular knitting machine of a diameter of 30 inches, from 1 to 10, preferably from 3 to 8 and most preferably 5 or 6 fans are used. Each ventilator fan 17 is preferably provided with a filter (not shown) at the suction inlet of the fan.

According to this configuration, as indicated by the arrows in FIG. 1, the outside air is drawn into the cylindrical chamber 13 by the ventilator fan 17, and runs through the gap 15 and the opening 14, and upwards along the cylinder cam holder 6, cooling the parts along the way.

Figure 5:
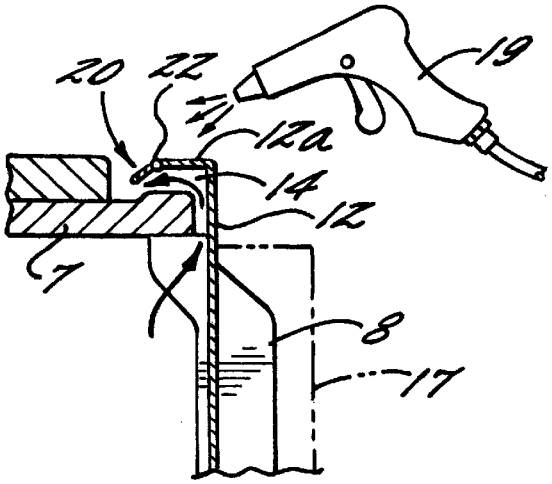
FIG. 5 shows a modified example of the upper end of the cover for the knitting section of the circular knitting machine according to the first embodiment of the present invention.
Figure 6:
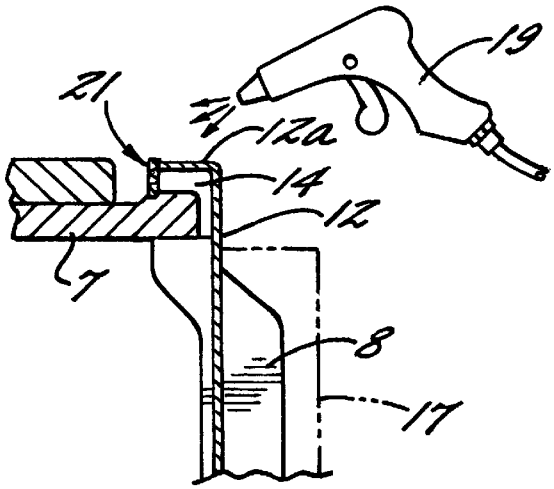
FIG. 6 shows another modified example of the upper end of the cover for the knitting section of the circular knitting machine according to the first embodiment of the present invention.

FIGS. 5 and 6 show two modified forms of the inverted L-shaped cover top 12*a*. In the modified form shown in FIG. 5, the tip of the cover is provided with a shutter 20 that closes or opens the opening 14 via a hinge 22. The hinge 22 can be made of any material as long as it is light enough to be opened or closed by air pressure. While the knitting machine is in operation, the shutter 20 is lifted upwards by the air running towards the core knitting section, so it does not block the air passage. On the other hand, when the knitting machine is out of operation for the purpose of cleaning the knitting machine using an air gun 19, the opening 14 is closed by the weight of the shutter 20 itself and the pressure of the air, thus preventing the intrusion of cotton dust.

In the modified form shown in FIG. 6, a filter 21 covering the entire area of the opening 14 is established at the tip of the cover top 12*a*. The filter can be made, for example, of a net equipped with meshes of a size capable of preventing the intrusion of cotton dust. While the knitting machine is in operation, the air running towards the core knitting section passes the net freely, so the net does not block the air passage. On the other hand, when the knitting machine is out of operation for the purpose of cleaning the knitting machine using the air gun 19, the filter prevents the intrusion of cotton dust.

Figure 2:
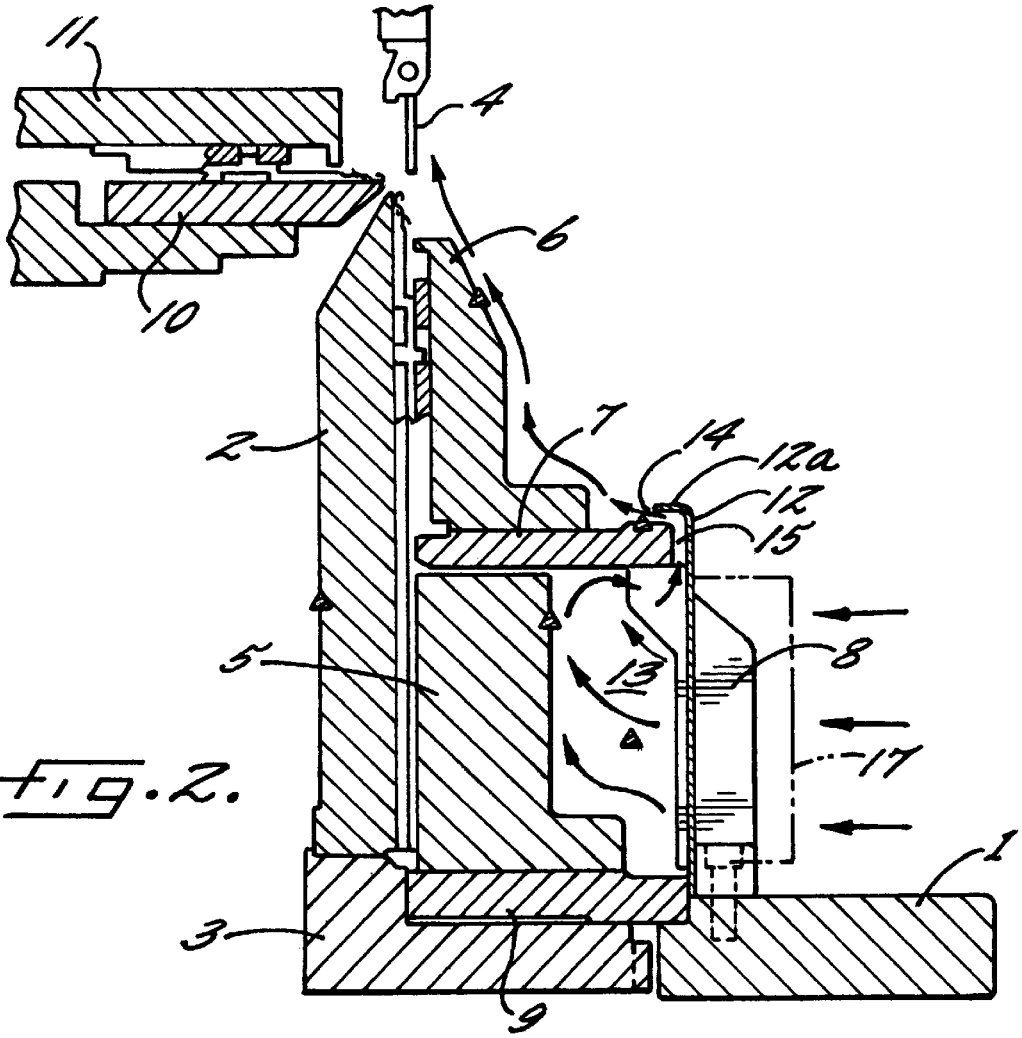
FIG. 2 is a cross sectional view of the knitting section of a circular knitting machine according to a second embodiment of the present invention.
Figure 3:
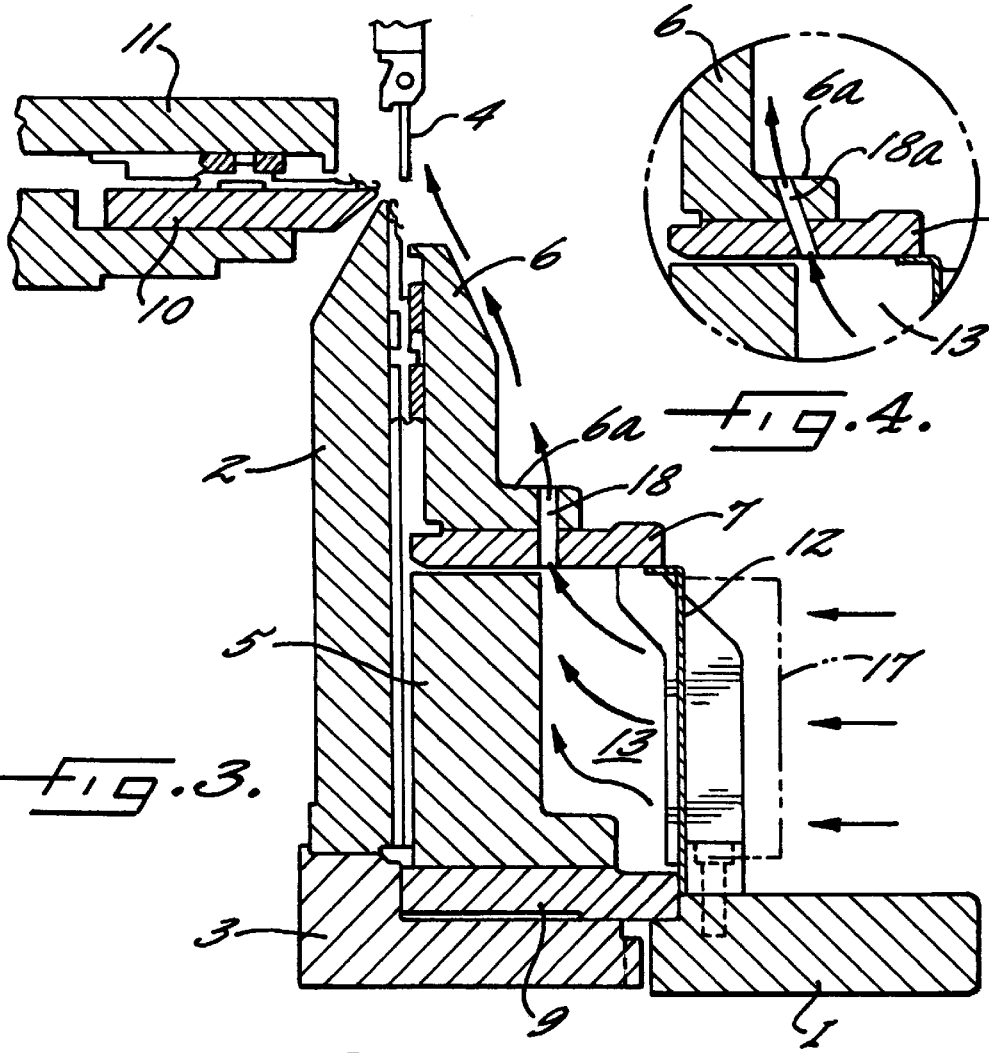
FIG. 3 is a cross sectional view of the knitting section of the circular knitting machine (according to the first embodiment of the present invention shown in FIG. 1) showing the points at which temperatures are measured for an effect-comparison test.

FIG. 2 is a cross sectional view of the knitting section of a knitting machine according to the second embodiment of the present invention. The parts that are functionally equivalent to those used in the first embodiment are given the same numbers, and their detailed explanations are not repeated.

The second embodiment is different from the first embodiment in respect of the following points:

1. The cover 12 is mounted so as to almost completely seal the space between the intermediate ring 7 and the lower ring 9.

2. Air holes (openings) 18 are formed so as to penetrate the intermediate ring 7 as well as a cylinder-cam-holder mount 6*a* which is used to mount the cylinder cam holder 6 onto the intermediate ring 7.

The number of air holes 18 can vary according to the size of the circular knitting machine, but for a circular knitting machine of a diameter of 30 inches, such number can be 10–100, but is preferably 30–80 and most preferably 50–60. The size of each air hole is preferably 5–20 mm, more preferably 8–15 mm and most preferably about 10 mm.

EFFECTS OF THE INVENTION

Using a double-knit circular knitting machine equipped with a knitting-tool-controlling apparatus (JP-A-9-21042 (1997)) by the present applicant, the temperatures of various parts of the knitting section were measured in order to compare operating results where the knitting machine is equipped with the apparatus of the present invention with operating results where the knitting machine is not equipped therewith.

The common knitting conditions were as follows:

Diameter of the knitting machine: 30 inches

Rotational frequency of the knitting machine: 23 rpm

Knit fabric: Interlock

Yarn: Polyester 75 denier

The different knitting conditions were as follows:

Prior Art 1

A sealed-type cover was installed. Because no ventilator fan was installed, there was no air flow into the inside of the cover. When the machine was run approximately 6,000 cycles under the above conditions, the temperature measurement exceeded 80° C., when the measurement was stopped.

Prior Art 2

A sealed-type cover and a fan were installed. This configuration is similar to JP-A-10-60759 (1998) referred to in the description of the prior art. In this configuration, the machine was run 10,000 cycles, and temperatures were taken when they stabilized.

The Present Invention

In the configuration described in the first embodiment (i.e., the size of the opening and gap were 15 mm each, and the number of fans was 6), the machine was run 10,000 cycles, and temperatures were taken when they stabilized.

Results

The results are shown in Table 1 below.

TABLE 1

Unit: ° C.

| | Prior Art 1 | Prior Art 2 | First Embodiment |
|---|---|---|---|
| (6) Cylinder cam holder | 76 | 73 | 59 |
| (7) Intermediate ring | 58 | 49 | 48 |
| (5) Actuator | 83 | 51 | 50 |
| (13) Inside cover (cylindrical chamber) | 63 | 34 | 41 |
| (2) Needle cylinder | 89 | — | 60 |
| Room temperature (3 m away from the knitting machine) | 23 | 20 | 26 |

Observation

The reason that the needle cylinder measured the highest temperatures is that when the knitting machine runs at high speed, friction occurs between the knitting tools (knitting needles, jacks, etc.) and the needle cylinder. Using the apparatus of the first embodiment of the present invention lowered the temperature (of the needle cylinder) when compared to Prior Art 1 by 29° C. The cylinder temperature of Prior Art 2 was not measured.

In Prior Art 1, the actuator generated the second highest temperature. The reason is that when knitting an interlock knit fabric as used in this test, the power consumption of the actuator is fairly large. Using the apparatus of the first embodiment of this invention, however, lowered the temperature of the actuator by 33° C. compared with Prior Art 1. Prior Art 2 resulted in a temperature 32° C. lower compared with Prior Art 1.

Heat from the intermediate ring is caused by thermal conduction from other parts as well as by the friction with the cams, etc., that are fastened to the intermediate ring. Using the apparatus of the first embodiment lowered the temperature of this part by 10° C. compared with Prior Art 1. Prior Art 2 resulted in a temperature 9° C. lower compared with Prior Art 1.

Except for the needle cylinder, for which the temperature was not measured for Prior Art 2, the present invention and Prior Art 2 did not produce significant differences in respect of the temperatures of the actuators and of the intermediate rings. The difference between the present invention and the prior arts was most significant in the case of the cylinder cam holder.

Heat from the cylinder cam holder is caused by the heat generated by the needle cylinder as well as by the friction with the cylinder cams, etc., that are fastened to the cylinder cam holder. While the apparatus of the first embodiment lowered the temperature of this section by 17° C., Prior Art 2 only lowered it by 3° C.

The temperature inside the cover of Prior Art 2 (34° C.) is lower than that of the first embodiment of the present invention (41° C.) by 7° C. It is believed that because the air of the test room was fed into the chamber inside the cover using a fan, the difference in the room temperatures in the case of the first embodiment (26° C.) and in the case of Prior Art 2 (20° C.) was directly reflected in the temperatures inside the cover. The difference between the room temperature and the temperature of the air inside the cover is about the same in each of these cases.

According to the above observation, the present invention is capable of efficiently cooling the needle cylinder and its peripheral parts using a relatively simple configuration. Even when compared with the closest prior art, the present invention produces an excellent result in respect of the cooling of the needle cam holder.

As a supplemental advantage of the present invention, the air flowing out of the opening is effective in blowing away the lint floating in the knitting section, thereby reducing its adherence to the knitting yarn and the resulting occurrences of defective fabrics and lowering of the operation rate of the knitting machine.

That which is claimed:

1. A cooling apparatus for working components in a circular knitting machine having a needle selecting actuator (5) for knitting a jacquard fabric; said needle-selecting actuator (5) being surrounded by an upper shield (7) at the top, a lower shield (9) at the bottom, a needle cylinder (2) inside, and a cover (12) outside, a cylindrical chamber (13) being formed between said needle selecting actuator (5) and the cover (12);

said cover being equipped with a means of ventilation/suction (17) for feeding the air into the cylindrical chamber (13);

said cylindrical chamber (13) having an opening (14, 15; 18) through which the air passes;

whereby outside air is fed into the cylindrical chamber (13) through the means of ventilation/suction (17) and passes through said opening (14, 15; 18) to cool the needle cylinder (2) and its peripheral working components.

2. An apparatus according to claim 1, in which said opening of the cylindrical chamber is a gap (14, 15) in the periphery of the cover.

3. An apparatus according to claim 2, wherein the upper end **(12*a*)** of the cover is formed in an inverted L shape orientated towards the other peripheral working components.

4. An apparatus according to claim 2, wherein the size of the gap (14, 15) in the periphery of the cover is 5–30 mm.

5. An apparatus according to claim 1, wherein the opening (14) is provided with a freely openable and closable shutter (20).

6. An apparatus according to claim 1, wherein the opening (14) is provided with a filter (21).

7. An apparatus according to claim 1, wherein the opening of the cylindrical chamber comprises air holes (18) that penetrate the upper shield.

8. An apparatus according to claim 7, wherein said air holes (18) are slanted so as to be orientated towards the other peripheral knitting components.

9. An apparatus according to claim 7, wherein the size of each air hole is 5–20 mm.

10. An apparatus according to claim 7, wherein the number of said air holes is within the range of 10–100.

* * * * *